US006890246B2

(12) United States Patent
Yamaharu

(10) Patent No.: US 6,890,246 B2
(45) Date of Patent: May 10, 2005

(54) DRY-ICE BLAST DEVICE

(76) Inventor: Eikichi Yamaharu, 15-10, Korigaoka 8-chome, Hirakata-shi, Osaka 573-0084 (JP)

( * ) Notice: Subject to any disclaimer, the term of this patent is extended or adjusted under 35 U.S.C. 154(b) by 0 days.

(21) Appl. No.: 10/312,059

(22) PCT Filed: Jun. 21, 2001

(86) PCT No.: PCT/JP01/05339

§ 371 (c)(1),
(2), (4) Date: Apr. 17, 2003

(87) PCT Pub. No.: WO01/98030

PCT Pub. Date: Dec. 27, 2001

(65) Prior Publication Data

US 2004/0005848 A1 Jan. 8, 2004

(30) Foreign Application Priority Data

Jun. 22, 2000 (JP) ..... 2000-187722

(51) Int. Cl.[7] ..... B24C 7/00; B24C 3/06
(52) U.S. Cl. ..... 451/99; 451/75; 451/92
(58) Field of Search ..... 451/38, 39, 75, 451/76, 89, 91, 92, 95, 97, 99, 101, 102, 90

(56) References Cited

U.S. PATENT DOCUMENTS

| | | | | | |
|---|---|---|---|---|---|
| 3,914,815 | A | * | 10/1975 | Kobayashi | 451/76 |
| 4,389,820 | A | * | 6/1983 | Fong et al. | 451/75 |
| 4,617,064 | A | * | 10/1986 | Moore | 451/39 |
| 5,184,427 | A | | 2/1993 | Armstrong | |
| 5,445,553 | A | * | 8/1995 | Cryer et al. | 451/75 |
| 5,716,257 | A | * | 2/1998 | Gallo et al. | 451/38 |
| 6,524,172 | B1 | * | 2/2003 | Rivir et al. | 451/99 |

FOREIGN PATENT DOCUMENTS

| | | |
|---|---|---|
| JP | 58-55849 | 4/1983 |
| JP | 04-360766 | 12/1992 |
| JP | 09-253737 | 9/1997 |

* cited by examiner

*Primary Examiner*—Hadi Shakeri
(74) *Attorney, Agent, or Firm*—Merchant & Gould P.C.

(57) ABSTRACT

A dry-ice blast device (A) includes an air compressor (2) of a low pressure type as a source of the compressed air, the delivery pressure being 1.2–2.5 atm. Dry-ice particle feeder (5), (6) is provided for mixing dry-ice particles (D) into the air flow in the air flow path upstream from a nozzle (32). This enables low pressure blasting, which suppresses the abrasion of the dry-ice particles (D), decreases the noise, reduces the overall size and weight of the device and makes easy the handling of the device.

11 Claims, 5 Drawing Sheets

DRY-ICE BLAST DEVICE

TECHNICAL FIELD

The present invention relates to a dry-ice blast device utilizing dry-ice particles as abrasives.

BACKGROUND ART

FIG. 6 illustrates the structure of a prior-art dry-ice blast device. The prior-art device includes an intermediate/high pressure type air compressor 90 for compressing air to no less than 8 atmospheres (atm). The device also includes an air dryer 91, a pipe 92 and a nozzle 93 which are connected to the discharge port of the air compressor. Further, the device is provided with a hopper 94 and a feeding unit 95 for feeding dry-ice particles D stored in the hopper to a pipe 92*a* branching from the pipe 92. After fed into the pipe 92*a*, the dry-ice particles D are put into the air flow in the nozzle 93.

With the above arrangement, the high-speed air flow with dry-ice particles D is discharged through the nozzle 93, so that the required blast treatment is performed by utilizing the dry-ice particles D as abrasives. The spent dry-ice particles D will sublime in a short period of time after hitting on the object of the blast treatment, which eliminates the need to collect the ejected particles.

It has been found, however, that the prior-art device suffers the following drawbacks.

First, the high-speed air jetted out through the nozzle 93 generates deafening noise, the sound pressure level of which may even reach 120 dB. Conceivably, this jet sound is produced when the air rapidly expands due to the sudden pressure change. Conventionally, when the operator performs the blast treatment while holding the nozzle 93 with his or her hand, the annoying noise is to be generated near the operator, which makes continuous work unbearable.

In the second place, when the high-speed air flow is jetted out through the nozzle 93, the air of no less than 8 atm rapidly expands to the atmospheric pressure, thereby generating a turbulent flow inside the nozzle 93. Due to this, the dry-ice particles D may be broken within the nozzle 93, which is a waste of the dry-ice particles.

In the third place, in passing through the pipe 92*a*, the dry-ice particles D strongly hit against the inner wall surface of the pipe 92*a*. This also causes the breakage or excessive wearing of the dry-ice particles.

In the fourth place, since the air compressor 90 is of an intermediate or high pressure type, the air compressor 90 and the attached equipment are expensive. Further, as being large and heavy, they are inconvenient for transfer. Conventionally, it is a predominant idea that the efficiency of blast treatment is enhanced as the air compressor generates a higher pressure of air flow. This is the reason why air compressors of an intermediate or high pressure type have been used. However, it will be understood from the following description of the present invention that the idea is not necessarily proper.

In the fifth place, upon reaching the nozzle 93, the dry-ice particles D are jetted out through the nozzle 93 by the high-speed air flow. In this manner, it is difficult to make stable the jetting direction of the dry-ice particles D. In the prior art device, since the pressure change is large when the high-speed air flow jets out through the nozzle 93 to the atmospheric pressure, the air flow is likely to spread through a relatively large angle, causing the dry-ice particles D to spread largely. In light of this, the device is not suitable for exclusive application of the blast treatment to the desired portion.

In the sixth place, since the pipe 92 and the branching pipe 92*a* are both connected to the nozzle 93, the operator needs to pull around the two pipes together, with the nozzle 93 held in the hands. This can be hindrance to smooth operation.

DISCLOSURE OF THE INVENTION

An object of the present invention is to provide a dry-ice blast device which eliminates or alleviates the problems described above.

According to the present invention, there is provided a dry-ice blast device comprising: an air compressor; an air flow path for guiding an air flow generated by the air compressor to a nozzle; and a dry-ice particle feeder for supplying dry-ice particles into the air flow. The air compressor is of a low pressure type having a delivery pressure of 1.2–2.5 atm (0.2–1.5 atm by gauge pressure). The dry-ice particle feeder supplies the dry-ice particles into the air flow at a position upstream along the air flow path from the nozzle.

Preferably, the dry-ice particle feeder may include a hopper having a bottom opening and storing the dry-ice particles, and a supplier for causing the dry-ice particles to be discharged through the bottom opening and introduced into the air flow path.

Preferably, the hopper may have an inner surface which is entirely or partially irregular for effecting point contact with the dry-ice particles.

Preferably, the irregular surface maybe coated with resin.

Preferably, the dry-ice blast device of the present invention may further comprise a knocker for knocking the hopper at a predetermined time interval for giving shock to the dry-ice particles contained in the hopper.

Preferably, the supplier may include a movable member which constantly separates the bottom opening of the hopper from the air flow path, and which receives the dry-ice particles from the hopper and feeds them to the air flow path.

Preferably, the supplier may comprise a rotary feeder which includes: a casing formed with a first and a second openings communicating with the bottom opening of the hopper and the air transfer path, respectively; a rotor rotatably arranged in the casing; and at least one accommodating portion provided in the rotor. The accommodating portion, upon rotation of the rotor, is moved to positions for communication with the first opening and the second opening of the casing, respectively, whereby the dry-ice particles are discharged downward from the bottom opening of the hopper into the accommodating portion and are further discharged downward from the accommodating portion into the air transfer path. The rotor of the rotary feeder keeps the first opening and the second opening separated from each other.

Preferably, the rotor may be provided with a plurality of accommodating portions which are separated by partition walls each of which has a width smaller than the respective widths of the first and the second openings.

Preferably, each of the accommodating portions may comprise a through-hole extending in the thickness direction of the rotor. The first and the second openings of the casing penetrate an upper wall and a lower wall of the casing, respectively. The rotor is rotatable between the upper wall and the lower wall of the casing about an axis extending in the thickness direction of the casing. The rotor has an upper surface and a lower surface. In these surfaces, an auxiliary piece is disposed at an edge of each of the accommodating portions. The rotor is provided with an elastic member for pressing the auxiliary piece against the upper or lower wall of the casing.

Preferably, the rotational speed of the rotor may be variable.

Preferably, the dry-ice blast device of the present invention may further comprise a check valve for preventing air from flowing reversely toward the air compressor. The check valve may be arranged in the air flow path upstream from a position where the dry-ice particles are fed from the dry-ice particle feeder.

Preferably, the air flow path may comprise a flexible hose disposed adjacent to an end of the air flow path. The hose may be provided with an operation switch and a wireless transmitter for outputting a wireless signal of data concerning the operational behavior of the operation switch. Based on the wireless signal from the wireless transmitter, the operation of the air compressor and the dry-ice particle feeder is controlled.

Preferably, the dry-ice blast device of the present invention may further comprise a transferable frame provided with wheels for effecting the required transfer. The frame may support the air compressor, a motor for driving the air compressor, the dry-ice particle feeder and piping constituting the air flow path.

Other features and advantages of the present invention will become clearer from the following description of the preferred embodiments of the invention.

BEST MODE FOR CARRYING OUT THE INVENTION

Preferred embodiments of the present invention will be described below in detail with reference to the accompanying drawings.

Figure 1:
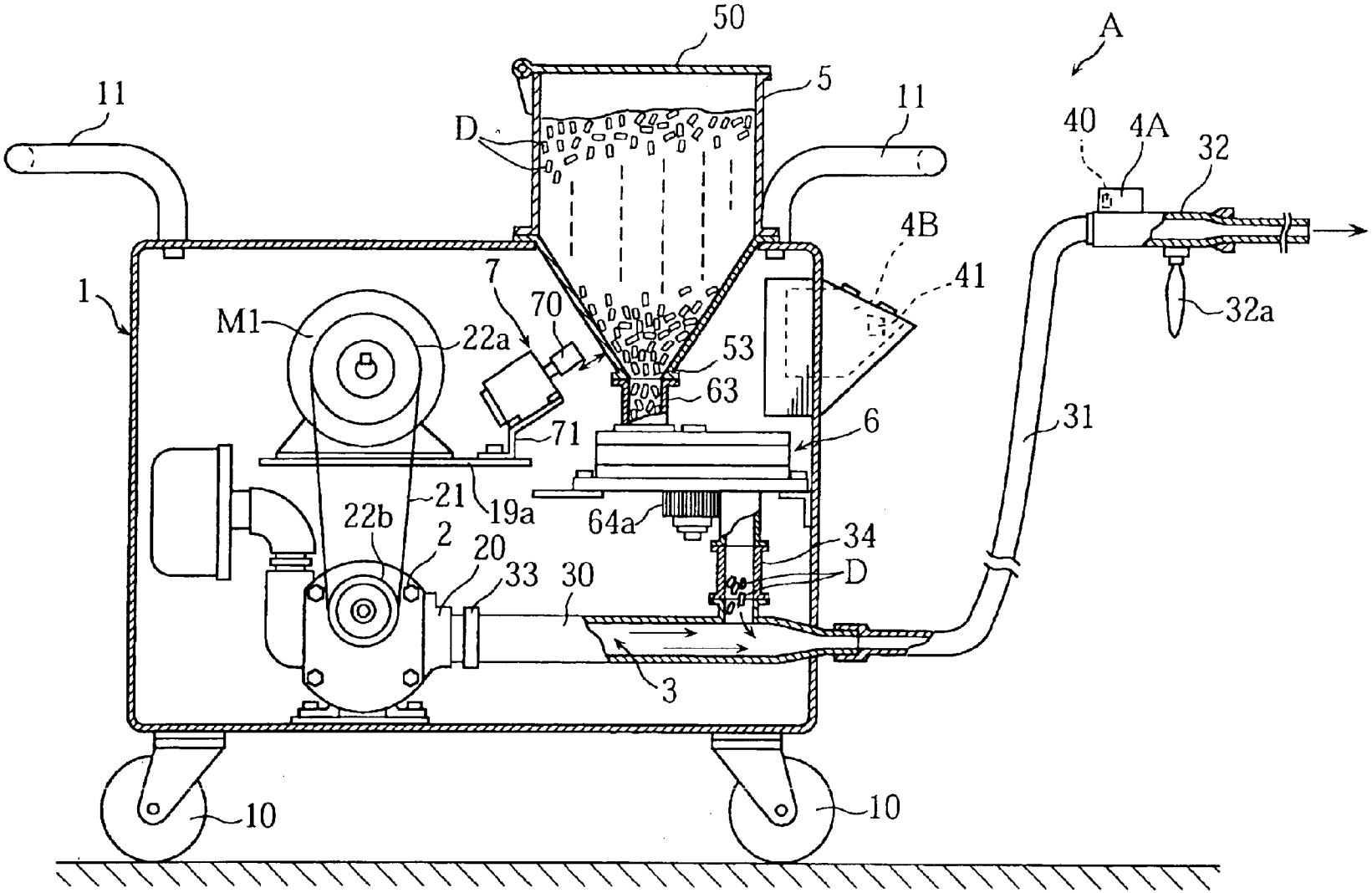
FIG. 1 is a side view illustrating, partially in section, an embodiment of the dry-ice blast device according to the present invention.

FIG. 1 illustrates an embodiment of a dry-ice blast device according to the present invention. The dry-ice blast device A according to this embodiment comprises a transferable frame 1, an air compressor 2, a pipe 30 connected to the discharge pipe 20 of the compressor 2, a hose 31, a nozzle 32, an operation unit 4A, a controller 4B, a hopper 5, a rotary feeder 6 and a knocker 7.

The transferable frame 1 is generally in the form of a box. Other parts constituting the dry-ice blast device A are directly or indirectly mounted to the transferable frame 1. The transferable frame 1 is provided with a plurality of wheels 10 for easy movement on the ground. At least one handle 11 is attached to the top of the frame 1.

The air compressor 2, which may be a Root's blower, can produce a large amount of air flow having a low pressure and high speed. The delivery pressure at the discharge pipe 20 may be 1.2–2.5 atmospheres (atm), and preferably 1.4–1.9 atm. The air compressor 2 is driven by a driving force which is generated by a motor M1 and transmitted through a belt 21 and a pair of pulleys 22*a*, 22*b*.

Figure 5:
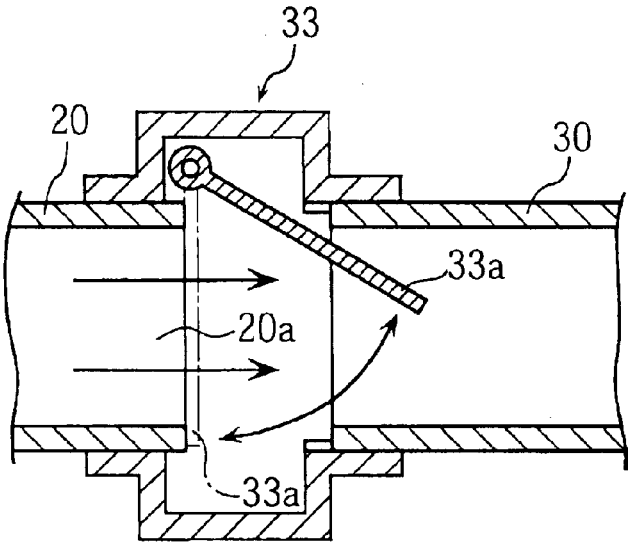
FIG. 5 is a sectional view illustrating a check valve of the dry-ice blast device shown in FIG. 1.
Figure 6:
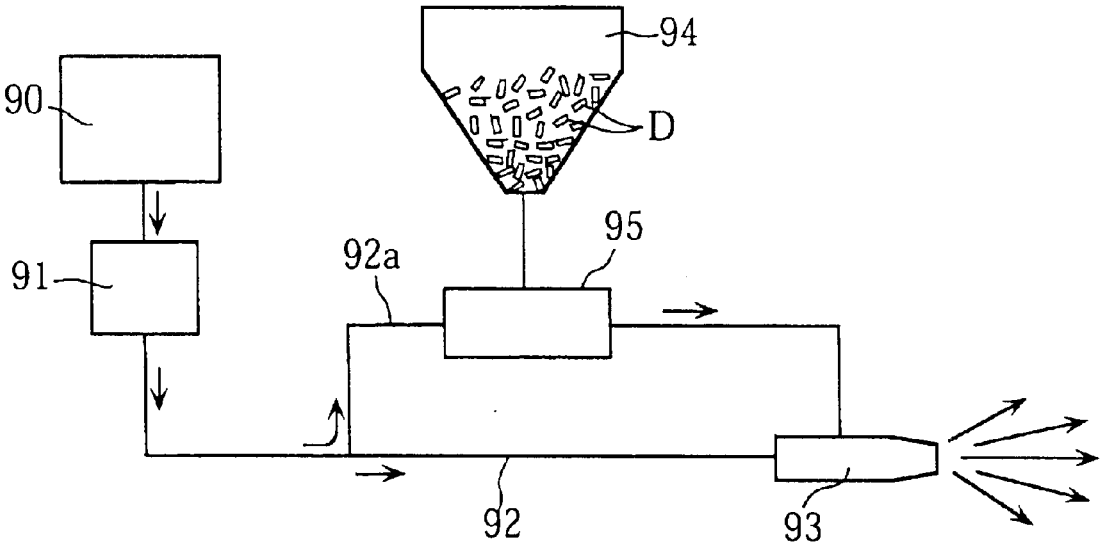
FIG.6 Prior Art
FIG. 6 illustrates a prior art device.

The pipe 30 and hose 31 offer an air flow path 3 for conducting the air flow generated by the air compressor 2 to the nozzle 32. The pipe 30 is associated with a branching pipe portion 34, which connects the pipe 30 to the rotary feeder 6. Dry-ice particles D are supplied through the branching pipe portion 34 to the pipe 30. Between the pipe 30 and the discharge pipe 20 of the air compressor 2 is arranged a check valve 33. As shown in FIG. 5, the check valve 33 includes a valve body 33*a* which is capable of swinging and can be brought into facing relation to an opening 20*a* of the discharge pipe 20. The valve body 33*a* allows the opening 20*a* to be free as indicated by solid lines in the figure when compressed air is discharged from the air compressor 2 toward the pipe 30. On the other hand, the check valve closes the opening 20*a* as indicated by phantom lines in the figure when a rotor in the air compressor 2 rotates reversely in malfunction. Thus, the check valve 33 can prevent the dry-ice particles D from being sucked into the air compressor 2. Though not depicted in the figures, the dry-ice blast device A may include an accumulator located upstream from the connecting portion between the air flow path 3 and the branching pipe portion 30. This structure makes it possible to prevent not only the generation of noise which would otherwise accompany the discharge of the compressed air, but also the surging of the air flow in the air flow path 3.

Referring to FIG. 1, the hose 31, which is flexible enough, is removably attached to the tip end of the pipe 30. The nozzle 32 is attached to the tip end of the hose 31 and is provided with a grip 32*a* so that the operator can hold it easily. The nozzle 32 may have a circular end opening. The nozzle 32 may be removable from the hose 31 for replacement with another nozzle having a different end opening (e.g. flat opening) configured suitably for the applications of the device. The nozzle 32 has a thin straight tubular end portion having a length of 30–60 cm. With this structure, the air flow containing the dry-ice particles D can be jetted out through the nozzle 32 stably in the aimed direction. This eliminates the need for the operator to come close to the object to be blasted. Generally, as the length of the nozzle 32 is increased, its weight also increases. In this embodiment, however, the nozzle 32 has a relatively small wall thickness because of the lower pressure of the air flow passing through the nozzle 32. This facilitates the handling of the nozzle 32 and serves to suppress the increase of the weight of the nozzle 32.

The operation unit 4A is provided with an operation switch for turning on and off the dry-ice blast device A. The operation unit is attached to the outer surface of the nozzle 32 for operational convenience. The operation unit 4A may further be provided with a control switch for controlling the feed amount (feed rate) of the dry-ice particles D from the rotary feeder 6 to the air flow path 3. The operation unit 4A includes a wireless transmitter 40 for sending data concerning the operational procedure in the form of an infrared signal or any other electric wave of a predetermined frequency. The controller 4B includes a wireless receiver 41 for receiving the wireless signals from the wireless transmitter 40. The controller 4B, mounted to the transferable frame 1, incorporates an electric circuit (not shown) for controlling the dry-ice blast device A in accordance with the signals received by the wireless receiver 41. Further, the controller 4B is provided with operation switches. Thus, the on-off operation and other operations for controlling the dry-ice blast device A can be performed using these switches or the above-mentioned switches on the operation unit 4A. Instead of using the wireless transmitter 40 and the wireless receiver 41, the operation unit 4A may be electrically connected to the controller 4B via a wiring harness. The harness may extend on the hose 31.

Figure 2:
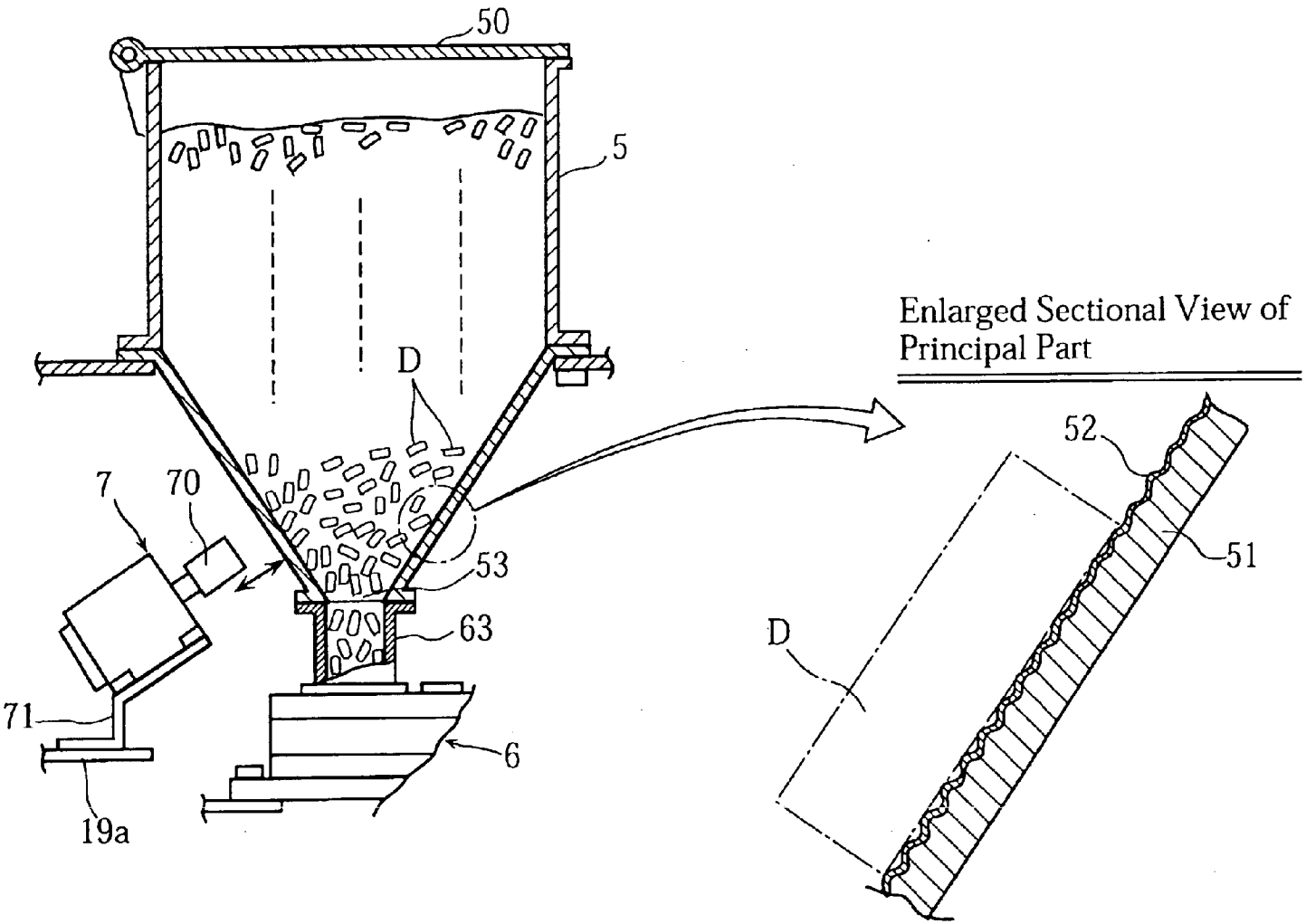
FIG. 2 is a sectional view illustrating a principal portion of the hopper of the dry-ice blast device shown in FIG. 1.

The hopper 5 to store the dry-ice particles D is fixed to the upper portion of the transferable frame 1. At least the lower half of the hopper 5 is in the form of a funnel formed with a bottom opening 53. The supply of the dry-ice particles D is performed through an upper opening of the hopper that is closable by a lid 50. The hopper 5 may be produced by processing a stainless steel plate and then resin-coating the entire inner surface thereof. Specifically, as clearly shown in FIG. 2, the hopper 5 is composed of a base structure 51 made of stainless steel, and a resin coating layer 52 of fluoroplastic formed on the base structure 51. The resin coating layer 52 has an irregular surface including a large number of minute projections or recesses that are smoothly connected to each other. Such resin coating layer 52 may be formed by firstly subjecting the surface of the base structure 51 to the blasting treatment using a hard abrasive, about 0.1–0.5 mm in diameter, to roughen the surface, and then coating the roughened surface with fluoroplastic to a thickness of about 5–10 $\mu$m. Preferably, the outer circumferential surface of the hopper 5 is surrounded by a heat insulator (not shown) for preventing the dry-ice particles D from subliming in the hopper 5.

The knocker 7 knocks the hopper 5 on a portion adjacent to its bottom to jolt the dry-ice particles D stored in the hopper 5, and is attached to a chassis 19*a* of the frame 1 via an appropriate bracket 71. The knocker 7 includes a reciprocating member 70 actuated by e.g. an electromagnetic solenoid to be brought into contact with the hopper 5. The knocking by the hopper 5 is performed intermittently at a predetermined time interval under the control of the controller 4B. The time interval can be varied by operating the operation switch of the controller 4B.

The rotary feeder 6 feeds a predetermined amount of dry-ice particles D from the hopper 5 to the air flow path 3 through the branching pipe portion 34. As clearly shown in FIG. 3, the rotary feeder 6 includes a casing 60, and a rotor 61 rotatably provided in the casing 60. The casing 60, fixed to chassis 19*b*, 19*c* of the frame 1, includes an upper wall 60*a* and a lower wall 60*b* facing each other, with a spacer 60*c* interposed therebetween. The upper wall 60*a* is connected to the bottom of the hopper 5 via a pipe 63 and includes a first opening 62*a* communicating with the bottom opening 53 of the hopper 5 via the pipe 63. The lower wall 60*b* is connected to the upper portion of the branching pipe portion 34 and includes a second opening 62*b* communicating with the air flow path 3 via the branching pipe portion 34. The first and the second openings 62*a*, 62*b* are offset from each other so that they do not overlap.

The rotor 61 is in the form of a circular plate and is rotated with a vertical shaft 64 penetrating through the central portion of the casing 60. A gear 64*a* or a pulley is attached to the shaft 64. The gear 64*a* or the pulley transmits the driving force from a non-illustrated motor to rotate the shaft 64 and hence the rotor 61. The rotational speed of the rotor 61 is variable. The rotor 61 is provided with a plurality of accommodating portions 65, or through-holes penetrating the rotor 61 in the thickness direction.

Figure 4:
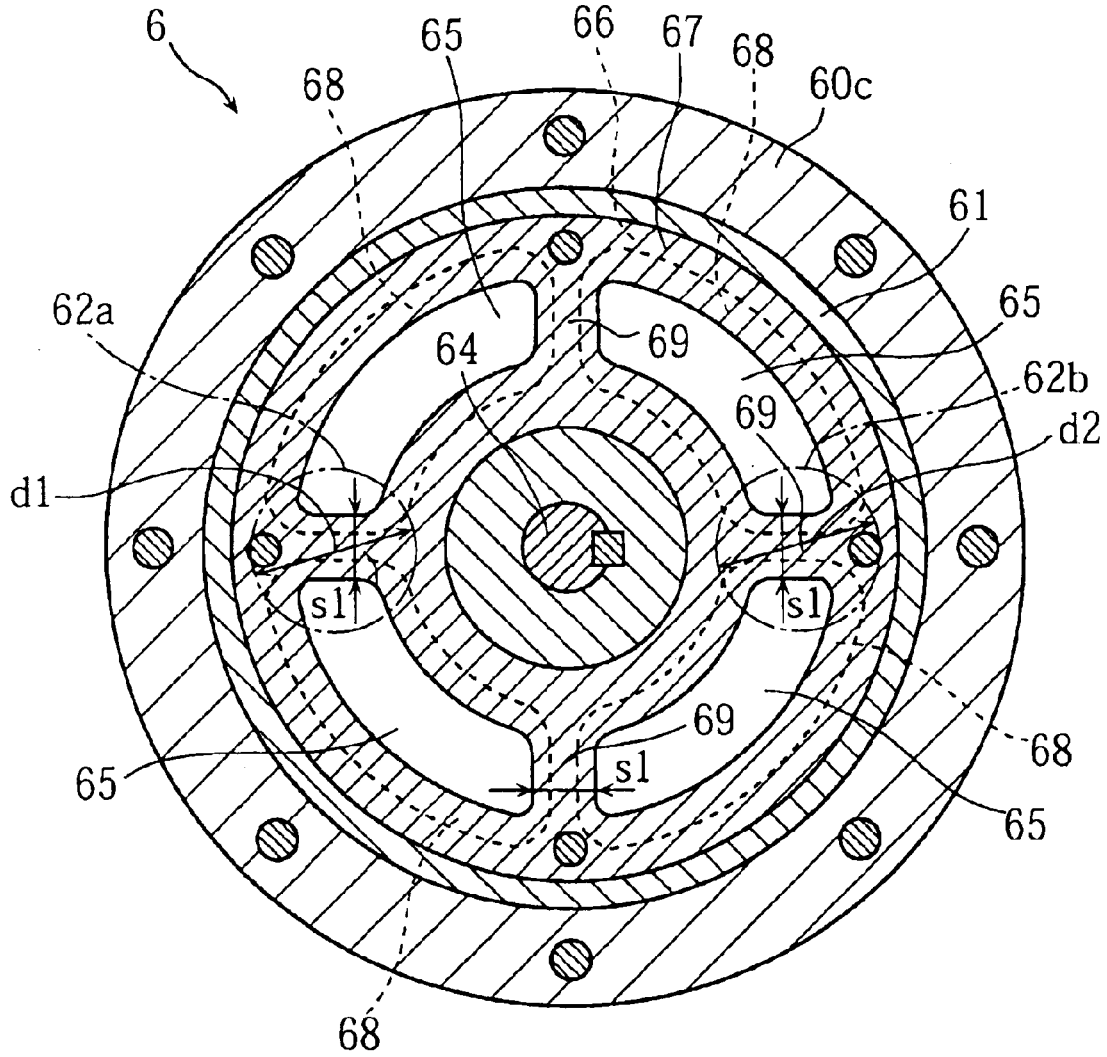
FIG. 4 is a sectional view taken along lines IV—IV in FIG. 3.

As clearly shown in FIG. 4, the accommodating portions 65 may be arcuately curved elongate holes, which successively communicate with the first and the second openings 62*a*, 62*b* of the casing 60 when the rotor 61 rotates. The accommodating portions 65 are separated by a plurality of partition walls 69. Each partition wall 69 has a width s1 which is smaller than the diameters d1, d2 of the first and the second openings 62*a*, 62*b*.

Figure 3:
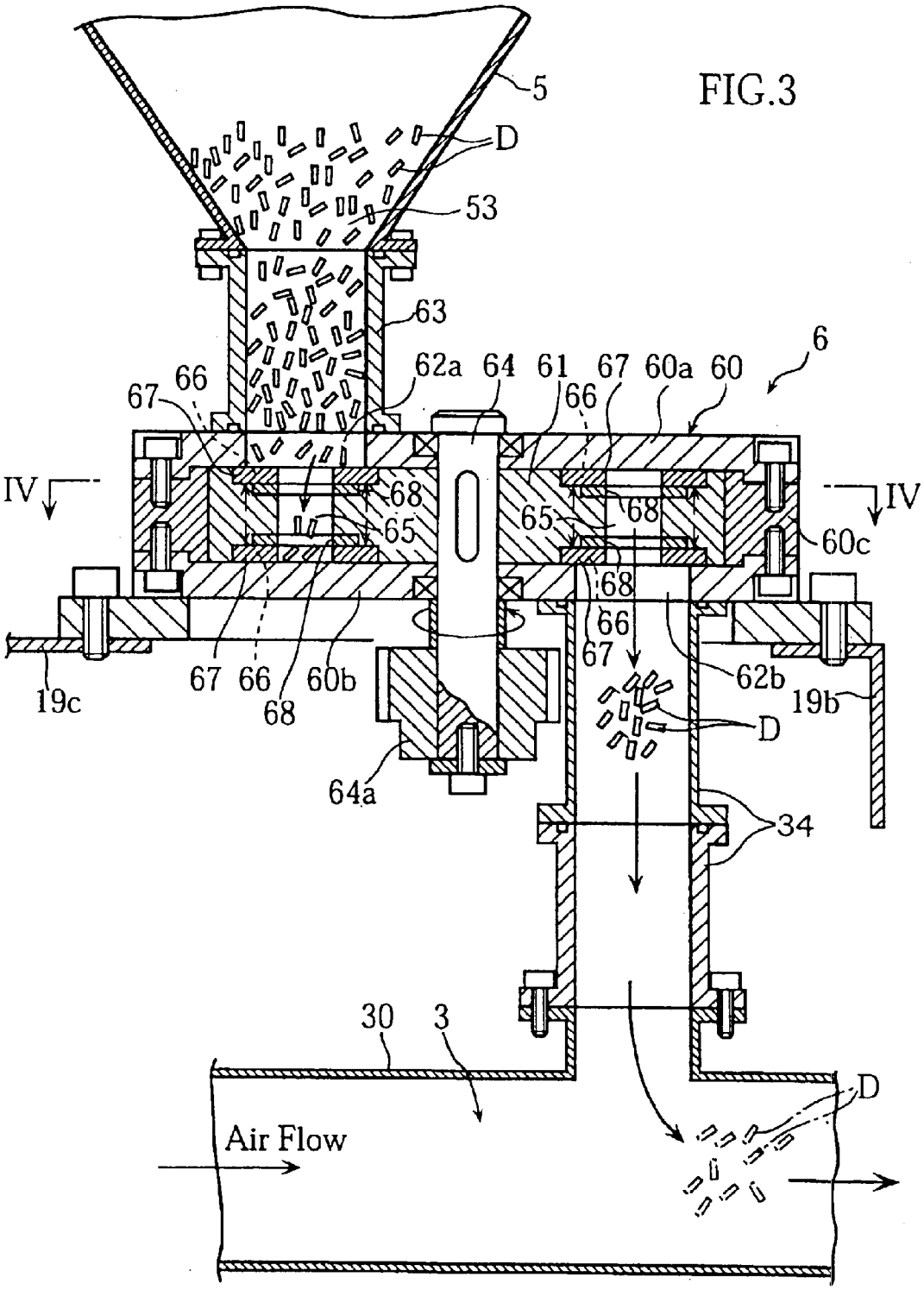
FIG. 3 is a sectional view illustrating a principal portion of the rotary feeder of the dry-ice blast device shown in FIG. 1.

As clearly shown in FIG. 3, the rotor 61 has an upper and a lower surfaces each of which is formed with a recess 66, into which a plate-like auxiliary piece 67, formed separately from the rotor 61, is fitted. The auxiliary piece 67 is formed with a plurality of through-holes configured similarly to the accommodating portions 65 so as not to close the accommodating portions 65. These through-holes can be regarded as a part of the accommodating portions 65. Between each auxiliary piece 67 and the rotor 61 are interposed a plurality of rubber sheets 68 which maybe made of silicone rubber. Due to the elasticity of the rubber sheets 68, the auxiliary piece 67 at the upper surface of the rotor 61 is pressed against the upper wall 60*a* of the casing 60, whereas the auxiliary piece 67 at the lower surface of the rotor 61 is pressed against the lower wall 60*b* of the casing 60. Silicone rubber is advantageous for making the rubber sheets 68 since the elasticity of the rubber sheets 68 is not significantly deteriorated even when the sheets are cooled by the dry-ice particles D. According to the present invention, however, use may be made of other materials than silicone rubber for making the elastic member interposed between the auxiliary piece 67 and the rotor 61.

Next, the workings of the dry-ice blast device A will be described.

For the dry-ice particles D, use may be made of particles each of which has a columnar shape with a diameter of 3 mm and a length of about 3–5 mm. Of course, the dry-ice particles D may have a different configuration and sizes. For performing the abrasive blasting, the air compressor 2 is operated to send an air flow of a predetermined low pressure into the air flow path 3, while the rotary feeder 6 is actuated to supply the dry-ice particles D from the hopper 5 to the air transfer path 3.

The rotary feeder 6 works as follows. Referring to FIG. 3, while the rotor 61 is rotating, one of the accommodating portions 65 comes directly under the first opening 62*a*. At this moment, the dry-ice particles D, discharged from the hopper 5 into the pipe 63, will pass through the first opening 62*a* to be received in the accommodating portion 65. Then, as the rotation of the rotor 61 continues, the particle-loaded accommodating portion 65 will move to the position directly above the second opening 62*b*. In this position, the dry-ice particles D are discharged downward through the second opening 62*b*, to be fed into the air flow path 3.

As described with reference to FIG. 4, the width of each partition wall 69 of the rotor 61 is smaller than the diameter dl of the first opening 62*a*. Therefore, even when the partition wall 69 is located directly under the first opening 62*a*, it does not completely close the first opening 62*a*. Thus, at any moment, at least one of the accommodating portions 65 is located under the first opening 62*a*, thereby permitting continuous feeding of the dry-ice particles D from the hopper 5 to the accommodating portions 65. Likewise, the width of each partition wall 69 is smaller than the diameter d2 of the second opening 62*b*. Therefore, the second opening 62*b*, also, is not completely closed by the partition walls 69. Thus, at least one of the accommodating portions 65 is located above the second opening 62*b*, which enables continuous discharge of the dry-ice particles D into the air flow path 3. In this manner, the air flow in the air flow path 3 is continuously supplied with dry-ice particles D, which enables nonstop ejection of the dry-ice particles D through the nozzle 32. It should be noted that each accommodating portion 65 is an elongated hole which is constant in width. Thus, the amount of the dry-ice particles D to be fed into the air transfer path 3 does not vary largely. The above example, however, does not limit the present invention, and the accommodating portion 65 may not be a non-elongated hole.

When the rotational speed of the rotor 61 is varied, the feed amount per unit time of dry-ice particles D to the air transfer path 3 can be changed. Thus, the mixing ratio of the dry-ice particles D to the air flow let out through the nozzle 32 can be controlled by the operator.

When the rotor 61 rotates, the elastic rubber sheets 68 force the auxiliary pieces 67 to come into sliding contact with the upper wall 60*a* or the lower wall 60*b* of the casing 60. Therefore, no gap is present between the auxiliary piece 67 and the upper wall 60*a*, and between the auxiliary piece 67 and the lower wall 60*b*. This serves to prevent the dry-ice particles D from being caught between these members. In the casing 60, the first opening 62*a* and the second opening 62*b* are always separated from each other by the rotor 61. In this manner, though compressed air flows through the air flow path 3, the compressed air does not act on the bottom opening 53 of the hopper 5. Therefore, even when surging or a pressure rise occurs in the air flow path 3, this does not hinder the smooth discharge of the dry-ice particles D through the bottom opening 53 of the hopper 5. On the other hand, the pressure of the second opening 62*b* and of the branching pipe portion 34 becomes equal to that of the air flow path 3. Thus, the dry-ice particles D are not blown up at these portions, but can fall into the air flow path 3 due to the gravity.

The dry-ice particles D may freeze water on or near the inner surface or the hopper 5, and the particles themselves would be attached to the inner surface of the hopper 5. In accordance with the above embodiment, however, the dry ice particle D and the irregular surface of the resin coating layer 52 on the inner surface of the hopper 5 are brought into point contact. With the reduced contact area, the dry-ice particles D are less likely to be caught on the surface of the resin coating layer 52. Since the surface of the resin coating layer 52 is made smooth so that the coefficient of friction is low, the dry-ice particles D are likely to slide and drop from the resin coating layer 52. This prevents the jamming of the dry-ice particles D in the hopper 5. Instead of providing the resin coating layer 52 to the hopper 5, the inner surface of the hopper 5 may comprise an irregular metal surface capable of realizing point contact with the dry-ice particles D. In this case again, the dry-ice particles D are less likely to stick to the inner surface of the hopper 5.

As noted above, the knocker 7 hits on the bottom of the hopper 5 at the prescribed time interval. The knocking can prevent the dry-ice particles D from being frozen onto the resin coating layer 52 or frozen onto each other. Further, the knocking can separate attached particles apart. Accordingly, the dry-ice particles D are discharged through the bottom opening 53 of the hopper 5 smoothly. The knocking by the knocker 7 on the hopper 5 makes some noise. The occurrence of noise, however, is intermittent and does not irritate the operator to an unbearable extent.

When the dry-ice particles D are fed from the rotary feeder 6 to the air flow path 3, the dry-ice particles D are mixed into the air flow in the air flow path 3 and transferred toward the nozzle 32 for ejection through the nozzle 32. When the dry-ice particles D pass through the air flow path 3, the dry-ice particles D hit against the inner surfaces of the pipe 30 and the hose 31. Advantageously, due to the relatively low-pressure air flow, the impact of the hitting is weaker than in the prior-art case where the pressure of the air flow is intermediate or higher. Therefore, it is possible to prevent the dry-ice particles D from being wasted due to excessive wear or breakage as a result of hitting against the inner surface of the pipe 30 or the hose 31.

Since the air flow has a relatively low pressure, the pressure change, which occurs when the air flow is jetted out through the nozzle 32, is smaller than in the case where the air flow has an intermediate or relatively high pressure. Therefore, a large turbulent flow is less likely to occur, so that the breakage of the dry-ice particles D due to such a turbulent flow can be avoided.

Further, because of the small pressure change, the noise caused by the jetting of the air flow is relatively small. With the dry-ice blast device A of this embodiment, the sound pressure level of the noise due to the jetting of the air flow can be decreased from the conventional 120 dB to about 75 dB. Because of the low-level noise, the operator can operate the device without suffering uneasiness, with the nozzle 32 held in the hand.

Moreover, since the pressure change is relatively small, the air flow jetting out through the nozzle 32 does not spread at a large angle from the nozzle 32. Therefore, the dry-ice particles D contained in the air flow also do not spread widely, which improves the ejection density of the dry-ice particles D. The dry-ice particles D are allowed to join the air flow at an upstream position spaced sufficiently away from the nozzle 32. In this way, the dry-ice particles D can be transferred by the air flow for a sufficiently long time. This contributes to the stabilization of the ejecting direction of the dry-ice particles D, and therefore the abrasive blasting can be concentrated on the desired portion.

The blast treatment utilizing dry-ice particles D is advantageous in that it does not cause much damage to the surface of the target, and that the spent dry-ice particles D will not be remnants to be collected. Thus, the dry-ice blasting can be suitably used for cleaning walls and floors of houses or buildings and also for cleaning domestic equipment such as fins of an air conditioner. In the blast device A of the present invention, necessary components are collectively mounted on the transferable frame 1 provided with wheels 10. Hence, the device can be easily moved. The reduced noise discussed above is also advantageous for domestic usage. Since the air compressor 2 is of a low pressure type, the weight and size of the air compressor 2 can be made smaller than those of an intermediate or high pressure type. Further, the hose 31 does not need to endure intermediate or higher pressure. In light of these, the device as a whole can be reduced in weight and size. Moreover, the dry-ice blast device A is more economical because the manufacturing cost and the running cost are lower than those of an air compressor of an intermediate or high pressure type.

The dry-ice blast device A has good operability, because the operator can control the operation of the dry-ice blast device A by the controller 4A attached to the nozzle 32. Further, since no other hoses than the hose 31 are connected to the nozzle 32, the operator only needs to pull the hose 31 around in handling the nozzle 32. In this way, the nozzle 32 can be manipulated more easily than in the prior art device wherein two pipes are connected to the nozzle.

The dry-ice blast device according to the present invention is not limited to the above-described embodiments, and the specific structure of each part maybe modified in various ways.

For example, as means for feeding dry-ice particles from the hopper to the air flow path, use may be made of a rotary feeder structured differently from the above-described one or means other than a rotary feeder. For example, a reciprocally movable member may be disposed between the bottom of the hopper and the air flow path for receiving the dry-ice particles discharged from the hopper and putting them into the air flow path. However, with such reciprocal means, the feeding of dry-ice particles to the air flow path becomes intermittent and continuous feeding is difficult. Therefore, for easily realizing continuous feeding of the dry-ice particles, rotary means may preferably be used.

The dry-ice blast device according to the present invention is not limited by the specific usage mentioned above.

What is claimed is:

1. A dry-ice blast device comprising: an air compressor, an air flow path for guiding an air flow generated by the air compressor to a nozzle, and a dry-ice particle feeder for supplying dry-ice particles into the air flow;

wherein the air compressor is of a low pressure type having a delivery pressure of 1.2–2.5 atm; and wherein the dry-ice particle feeder supplies the dry-ice particles into the air flow at a position upstream along the air flow path from the nozzle;

wherein the dry-ice particle feeder includes a hopper having a bottom opening and storing the dry-ice particles, and a supplier for causing the dry-ice particles to be discharged through the bottom opening and introduced into the air flow path through a branching pipe portion which transversely branches from the air flow path for allowing gravitational fall of the dry-ice particles and is located out of alignment with the bottom opening;

wherein the supplier includes a movable member having a plurality of accommodation portions for successively coming into communication with the bottom opening of the hopper and the pipe portion, the movable member constantly preventing the bottom opening of the hopper from directly communicating with the branching pipe portion.

2. The dry-ice blast device according to claim 1, wherein the hopper has an inner surface which is entirely or partially irregular for effecting point contact with the dry-ice particles.

3. The dry-ice blast device according to claim 2, wherein the irregular surface comprises a resin-coated surface.

4. The dry-ice blast device according to claim 1, further comprising a knocker for knocking the hopper at a predetermined time interval for giving shock to the dry-ice particles contained in the hopper.

5. The dry-ice blast device according to claim 1, wherein the supplier further comprises a casing formed with first and second openings communicating with the bottom opening of the hopper and the branching pipe, respectively; the movable member being a rotor rotatably arranged in the casing; wherein the accommodating portions, upon rotation of the rotor are moved to positions for communication with the first opening and the second opening of the casing, respectively, whereby the dry-ice particles are discharged downward from the bottom opening of the hopper into the accommodating portions and are further discharged downward from the accommodating portions into the air transfer path via the branching pipe portion, and wherein the rotor keeps the first opening and the second opening separated from each other.

6. The dry-ice blast device according to claim 5, wherein the plurality of accommodating portions are separated from each other by partition walls each having a width smaller than widths of the first and the second openings.

7. The dry-ice blast device according to claim 6, wherein each of the accommodating portions comprises a through-hole extending in a thickness direction of the rotor, the first and the second openings of the casing penetrating an upper wall and a lower wall of the casing, respectively, the rotor being rotatable between the upper wall and the lower wall of the casing about an axis extending in a thickness direction of the casing, and wherein the rotor has an upper surface and a lower surface each of which is provided with an auxiliary piece disposed at an edge of one of the accommodating portions, the rotor being provided with an elastic member for pressing the auxiliary piece against the upper wall or the lower wall of the casing.

8. The dry-ice blast device according to claim 5, wherein the rotational speed of the rotor is variable.

9. The dry-ice blast device according to claim 1, further comprising a check valve for preventing air from flowing reversely toward the air compressor, the check valve being arranged in the air flow path upstream from a position where the dry-ice particles are fed from the dry-ice particle feeder.

10. The dry-ice blast device according to claim 1, wherein the air flow path includes a flexible hose disposed adjacent to an end of the air flow path, the hose being provided with an operation switch and a wireless transmitter for outputting a wireless signal of data concerning an operational behavior of the operation switch, and wherein the air compressor and the dry-ice particle feeder in operation are controlled based on the wireless signal outputted from the wireless transmitter.

11. The dry-ice blast device according to claim 1, further comprising a transferable frame provided with wheels for effecting required transfer, wherein the air compressor, a motor for driving the air compressor, the dry-ice particle feeder and piping constituting the air flow path are mounted on the transferable frame.

* * * * *